US009863180B2

(12) United States Patent
Haberland

(10) Patent No.: US 9,863,180 B2
(45) Date of Patent: Jan. 9, 2018

(54) ASSEMBLY FOR CLOSING AN OPENING

(71) Applicant: Centor Design Pty Ltd, Eagle Farm (AU)

(72) Inventor: Martin Haberland, Wynnum (AU)

(73) Assignee: CENTOR DESIGN PTY LTD., Queensland (AU)

( * ) Notice: Subject to any disclaimer, the term of this patent is extended or adjusted under 35 U.S.C. 154(b) by 0 days.

(21) Appl. No.: 14/429,578

(22) PCT Filed: Sep. 11, 2013

(86) PCT No.: PCT/AU2013/001032

§ 371 (c)(1),
(2) Date: Mar. 19, 2015

(87) PCT Pub. No.: WO2014/043741

PCT Pub. Date: Mar. 27, 2014

(65) Prior Publication Data

US 2015/0233172 A1 Aug. 20, 2015

(30) Foreign Application Priority Data

Sep. 19, 2012 (AU) ..... 2012904090

(51) Int. Cl.
*E06B 3/46* (2006.01)
*E05D 15/36* (2006.01)
(Continued)

(52) U.S. Cl.
CPC ..... *E06B 3/469* (2013.01); *E05D 15/0621* (2013.01); *E05D 15/36* (2013.01); *E06B 3/4636* (2013.01); *E06B 7/04* (2013.01)

(58) Field of Classification Search
CPC ..... E05F 2017/005; E05F 2017/007; A47H 5/08; E06B 9/40; E06B 9/54; E06B 9/264
(Continued)

(56) References Cited

U.S. PATENT DOCUMENTS 671,414 A * 4/1901 Pyle ..... E06B 9/54 160/100
2,015,993 A * 10/1935 Drake ..... E06B 9/54 160/23.1

(Continued)

FOREIGN PATENT DOCUMENTS

EP 0844360 5/1998
WO 2004048741 6/2004

OTHER PUBLICATIONS

English abstract of EP0844360, published May 27, 1998.

*Primary Examiner* — Katherine W Mitchell
*Assistant Examiner* — Catherine A Kelly
(74) *Attorney, Agent, or Firm* — Porter Wright Morris & Arthur LLP

(57) ABSTRACT

An assembly for closing an opening comprising a door panel adapted for sliding movement between an open position and a closed position, a first extendable member located at a first edge of the opening and extendable towards an opposed second edge of the opening, and a second extendable member located at the second edge of the opening and extendable towards the first edge of the opening, and wherein the door panel includes a stop member attached thereto and movable therewith, the location of the stop member defining the limit of movement of the first extendable member towards the second edge of the opening, and the limit of movement of the second extendable member towards the first edge of the opening.

23 Claims, 8 Drawing Sheets

(51) Int. Cl.
*E05D 15/06* (2006.01)
*E06B 7/04* (2006.01)

(58) Field of Classification Search
USPC ..... 160/99, 102
See application file for complete search history.

(56) References Cited

U.S. PATENT DOCUMENTS 2,509,398 A * 5/1950 Peremi ..... E06B 9/54 160/23.1
2,538,210 A * 1/1951 Pirrie ..... E06B 9/264 160/33
4,079,771 A * 3/1978 Theiss ..... A47H 1/102 160/102
4,993,468 A * 2/1991 Hackman ..... E06B 9/264 160/100
5,740,849 A * 4/1998 Tashman ..... E05B 65/087 160/102
6,059,007 A * 5/2000 Tomita ..... E06B 9/54 160/242
6,138,738 A * 10/2000 Moller ..... E06B 9/581 160/264
6,167,936 B1 * 1/2001 Stover ..... E06B 9/54 160/100
6,435,254 B1 * 8/2002 Todd ..... A47K 3/38 160/309
6,470,947 B1 * 10/2002 Holevas ..... E06B 7/03 160/100
7,703,498 B2 * 4/2010 Holevas ..... E06B 9/60 160/100
8,534,343 B2 * 9/2013 Yi ..... E06B 9/063 160/102
2005/0263255 A1 * 12/2005 Phoy ..... E06B 9/264 160/98
2006/0054762 A1 * 3/2006 Shafeek ..... A47H 5/08 248/304
2007/0227676 A1 * 10/2007 Legay ..... E06B 7/03 160/102
2008/0053623 A1 * 3/2008 Goldenberg ..... E06B 9/52 160/31
2009/0236050 A1 * 9/2009 Marzilli ..... E06B 9/40 160/241
2012/0199294 A1 * 8/2012 Fayette ..... E06B 3/4415 160/99
2012/0285633 A1 * 11/2012 Lin ..... B60J 1/2047 160/293.1

* cited by examiner

ASSEMBLY FOR CLOSING AN OPENING

The present invention relates to an assembly for closing an opening. In particular, the present invention relates to a screen assembly for closing an opening, such as a window or door opening.

BACKGROUND ART

In many conventional sliding door assemblies, a screen may be provided, such that, when the door is open, the screen that may be drawn across the door opening to close the opening and prevent the ingress into a building of insects, leaves or other debris. Typically, the screen is a mesh screen, such a flywire or the like.

To addition, many conventional sliding door assemblies also include (on a separate track to the screen) a blind that can be drawn across the opening to provide privacy, or to provide relief in hot, sunny or windy conditions.

A drawback of these conventional assemblies is, however, that the screen, the blind (or both) may be drawn across substantially the entire opening, regardless of the position of the door. Thus, particularly when a blind is drawn across the opening, it may not be possible to determine whether the door is open or closed. This can lead to a situation where a user may forget to close a door, thereby creating a security risk. Additionally, the blind may be drawn across the opening, exposing delicate fabric to the exterior elements, resulting in it becoming damaged or dirty. A further drawback of a conventional assembly is that if the screen is drawn entirely or substantially across the opening by a person inside the building, another person located outside the building may be inadvertently prevented from re-entering the building as they are unable to reach the screen stile which is now located behind a glass panel or panels.

In addition, being unable to visually determine the position of the door could lead to a situation in which heating or cooling is used within a building while the door remains open. This presents a significant waste of energy, and associated increases in power costs.

Thus, there would be an advantage if it were possible if it were possible to provide an assembly for closing an opening that allowed a user to visually determine the position of a door, and to prevent the blind passing beyond the position of the door stile.

It will be clearly understood that, if a prior art publication is referred to herein, this reference does not constitute an admission that the publication fours part of the common general knowledge in the art in Australia or in any other country.

SUMMARY OF INVENTION

The present invention is directed to an assembly for closing an opening, which may at least partially overcome at least one of the abovementioned disadvantages or provide the consumer with a useful or commercial choice.

With the foregoing in view, the present invention in one form, resides broadly in an assembly for closing an opening comprising a door panel adapted for sliding movement between an open position and a closed position, a first extendable member located at a first edge of the opening and extendable towards art opposed second edge of the opening, and a second extendable member located at the second edge of the opening and extendable towards the first edge of the opening, and wherein the door panel includes a stop member attached thereto and movable therewith, the location of the stop member defining the limit of movement of the first extendable member towards the second edge of the opening, and the limit of movement of the second extendable member towards the first edge of the opening.

The door panel may be of any suitable form. Preferably, however, the door panel is a sliding door panel. The door panel may be fabricated from any suitable material, and it will be understood that the exact construction of the door panel (including the size and shape thereof) is not critical. Notwithstanding, it is envisaged that the door panel may at least partially comprise a clear or semi-opaque portion, such as a glass portion.

It is envisaged that the door panel will slide along a track. Any conventional sliding door track may be used, and it will be understood that the exact nature of the track and fittings is not critical.

In some embodiments of the invention, the assembly may comprise a plurality of door panels. In a preferred embodiment, the assembly may comprises a fixed door panel fixed at or adjacent the first or second edges of the opening, and one or more sliding door panels that are slidable relative to the fixed door panel. In this embodiment of the invention, it is envisaged that the one or more sliding door panels will extend across the opening such that one of the one or more sliding door panels abuts the opposed edge of the opening when the assembly is in the closed position.

Preferably, the stop member is located on one of the one or more sliding door panels. The stop member may be located at any suitable location on the one or more sliding door panels. However, in a preferred embodiment of the invention, it is envisaged that the stop member may be located on the sliding door panel that abuts the edge of the opening when the assembly is in the closed position. The stop member may be located at any point on the sliding door panel that abuts the edge of the opening when the assembly is in the closed position, although it is envisaged that stop member may be located at or adjacent the edge of the sliding door panel that abuts the edge of the opening. In other words, the stop member may preferably be located on, or form part of, the leading stile of the sliding door panel.

The stop member may be of any suitable form. In some embodiments of the invention, the stop member may comprise a projection extending from the surface of the sliding door panel. The stop member may comprise a single stop member extending along at least a portion of the height of the sliding door panel (for instance, an elongate stop member), or may comprise a plurality of stop members positioned at different vertical heights on the door panel.

In some embodiments of the invention, the stop member or stop members may be positioned on the door panel so as not to be visible to a user, or at least so as not to be readily visible to a user. In this embodiment of the invention, the stop member or stop members may be located on a section of the door panel that is located within a head track or sill. Alternatively, the stop member or stop members may be located on a section of the door panel that is positioned behind a pelmet or the like. In this way, the stop member or stop members do not disrupt the aesthetic appeal of the door panel.

In some embodiments of the invention, the sliding door panel may be provided with a first stop member (or members) adapted to define the limit of extension of the first extendable member, and a second stop member (or members) adapted to define the limit of extension of the second extendable member.

In embodiments of the invention in which a the sliding door panel is provided with a first and second stop member or members), the first and second stop member (or members) may be provided on opposed surfaces of the sliding door panel. However, in a preferred embodiment of the invention, the first and second stop member for members) are provided on the same surface of the sliding door panel.

The first and second extendable members may be of any suitable form. In some embodiments of the invention, the first extendable member may be a screen, while the second extendable member may be a blind. Preferably, both the first and second extendable members are in the form of elongate flexible members, it is envisaged that the first and second extendable members may be wound onto winding members (such as a rod or the like) at the respective edges of the opening. The extendable members may then be manually or automatically extended by applying a force to a leading edge of the extendable member in the direction of the opposed edge of the opening.

In an alternative embodiment of the invention, at least one of the first and second extendable members may be provided in the form of a sliding panel. For instance, the panel may be provided with a rigid frame, and the flexible screen or blind material may be held within the rigid frame. In this embodiment of the invention, the sliding panel or panels will retract beyond the edges of the opening when in the open position.

It is envisaged that the stop member (or members) may extend sufficiently from the surface such that the leading edges of the first and second extendable members abut the stop member (or members). The leading edges may simply abut the stop member, or may be received in a receiving portion of the stop member. In some embodiments, the stop member for members) may be adapted to engage with one or both of the first and second extendable members, such that the first extendable member and/or the second extendable member may be retained in abutment with the stop member (or members).

The first and second extendable members may be retained in abutment with the stop member using any suitable technique. In some embodiments of the invention, the first and/or second extendable members may be provided with one or more engagement members adapted to engage with one or more engagement members located on the stop member.

The one or more engagement members may be of any suitable form. For instance, the one or more engagement members may comprise a projection on the extendable member or stop member adapted to be received in, and retained by, a receiving member located on the other of the extendable member or stop member, such as in a latch mechanism. Alternatively, the engagement members may be projections adapted to be connected to one another. In some embodiments of the invention, the engagement members may retain the stop member and the extendable members in a frictional engagement.

In an alternative embodiment of the invention, the engagement members may comprise magnetic members, such that the first extendable member and the stop member and/or the second extendable member and the stop member are retained in magnetic engagement with one another. Any suitable magnetic members may be used, such as permanent magnets, powered magnets or the like. For instance, the extendable members may be provide with one or more magnets located on and/or under the surface of one or both of the extendable member and the stop member, such that, upon being brought into relatively close proximity, the magnetic attraction between the magnets brings the stop member and the extendable member into abutment with one another. In other embodiments of the invention, a magnet may be provided on either the stop member or the extendable member, while the other of the stop member or the extendable member may be provided with a ferromagnetic member. In this embodiment of the invention, when the magnet and the ferromagnetic member are brought into relatively close proximity with one another, the magnetic attraction between the magnet and the ferromagnetic member brings the stop member and the extendable member into abutment with one another.

By retaining the first and/or second extendable members in engagement with the stop member, any movement of the door panel automatically results in a change of position of the first and/or second extendable members. This makes adjusting the assembly very simple and very accurate.

It is envisaged that, in some embodiments of the invention (such as when the stop member is located at an upper or lower edge of the door panel) the first and second extendable members may engage directly with one another instead of with the stop member. In these particular embodiments, the first and second extendable members may be provided with magnets that, when the magnets are brought into relatively close proximity with one another, the magnetic attraction between the magnets brings the first and second extendable members into abutment with one another.

Alternatively, a magnet may be provided on either the first or the second extendable member, while the other of the first or the second extendable member may be provided with a ferromagnetic member. In this embodiment of the invention, when the magnet and the ferromagnetic member are brought into relatively close proximity with one another, the magnetic attraction between the magnet and the ferromagnetic member brings the first and second extendable members into abutment with one another. In this embodiment of the invention, the stop member is positioned between the first and second extendable members such that any movement of the door panel automatically results in a change of position of the first and/or second extendable members.

In some embodiments of the invention, the first and/or second extendable members may be provided with one or more additional magnets or ferromagnetic members adapted to be brought into magnetic engagement with one or more magnets or ferromagnetic members located on a stile or on the door panel. It is envisaged that these one or more additional magnets or ferromagnetic members may be used to increase the strength of the seal between the first and/or second extendable members and the stile or door panel. In this way, the likelihood of the first and/or second extendable members becoming accidentally disconnected from the stile, door panel or stop member may be decreased.

In use, the stop member is adapted to prevent the movement further movement of the first and second extendable members towards the opposed edges of the opening.

In a most preferred embodiment of the invention, the extendable member that extends from the edge of the opening adjacent the fixed door panel is a blind. In this way, the blind will only ever cover the door panels, and not the opening created when the sliding door panel is moved into the open position. In using this arrangement, the blind is never exposed to wind, water or flying debris from outside the structure.

Similarly, it is preferred that the extendable member that extends from the opposite edge of the opening to the fixed sliding panel is a screen. By locating the screen at this end of the assembly, the door panels will never be located behind the screen, which is both aesthetically pleasing and functionally efficient in that an optimal amount of screen material may be provided given that the screen can never overlap the door panels.

The arrangement of the screen described above is highly advantageous compared to conventional assemblies. In conventional assemblies, ensuring that the screen does not cover the door panels is achieved by placing the rod onto which the screen is wound at the centre mullion area, resulting in the screen roll and screen stile being positioned in the middle of the door opening when the screen is retracted. This creates a cluttered, visually unappealing result.

In some embodiments of the invention, each of the first and second extendable members may be provided with its own track along which it slides. Alternatively, the first and second extendable members may be located on a single common track. It is envisaged that the track along which the door panel slides is separate to the track along which the first and second extendable members slide.

The edges of the opening from which the first and second extendable members extend may be any suitable edges of the opening, such as the vertical edges or the horizontal edges. Preferably, however, the edges of the opening from which the extendable members extend are the vertical edges.

In some embodiments of the invention, the assembly may comprise a third extendable member positioned so as to extend in a direction that is substantially perpendicular to the direction in which the first and second extendable members extend. For instance, the first and second extendable members may extend in a substantially horizontal direction, while the third extendable member may extend in a substantially vertical direction. In a preferred embodiment of the invention, the third extendable member may comprise a screen or blind that extends from either an upper or lower edge of the opening towards the other of the upper or lower edges. The screen or blind may be of any suitable form, such as, but not limited to, a roller (Holland) blind, Roman blind, Venetian blind, or the like.

In an alternative embodiment of the invention, the second extendable member may be positioned so as to extend in a direction that is substantially perpendicular to the direction in which the first extendable member extends.

With the foregoing in view, the present invention in one form resides broadly in an assembly the closing an opening comprising a door panel adapted for sliding movement between an open position and a closed position, a first extendable member located at a first edge of the opening and extendable towards an opposed second edge of the opening, and a second extendable member located at a third edge of the opening and extendable towards an opposed fourth edge of the opening, and wherein the door panel includes a stop member attached thereto and movable therewith, the location of the stop member defining the limit of movement of the first extendable member towards the second edge of the opening, and wherein when the door panel is not in the closed position, the stop member defines the limit of movement of the second extendable member towards the fourth edge of the opening.

Preferably, the first and second edges of the opening are substantially parallel to one another. In addition, it is preferred that the third and fourth edges of the opening are substantially parallel to one another. In a preferred embodiment of the invention, the first and second edges of the opening and the third and fourth edges of the opening are substantially perpendicular to one another.

Although the present invention has been described largely in terms of a sliding door, it will be understood that the present invention could be applied equally to a sliding window or other suitable opening.

The advantage of the present invention is that, due to the fact that neither the screen nor the blind can extend beyond the leading stile of the sliding door, a user will immediately be able to determine whether the door is open or closed by a simple visual inspection, regardless of the relative positions of the door, screen and blind. Thus, the likelihood of leaving a door (and particularly an external door) open due to an inability to easily check the position of the door is significantly reduced, if not eliminated. In this way, security lapses may be avoided.

A further advantage of the present invention is its operational and visual simplicity. The interaction between the extendable blind and the leading edge member of the sliding door panel ensures that the blind fabric (which may be delicate) is always protected behind the door panel (which may be a glass panel), and therefore the blind does not form a barrier to a person attempting to enter the building from outside. Similarly, the interaction between the extendable screen and the leading edge member of the sliding panel ensures that only the open portion of the door opening is covered by a screen, meaning that the screen material is not drawn across the door panels where it would interfere with the aesthetics of the door (such as the ability to look through a glass door panel), while simultaneously ensuring that access to the edge member of the extendable screen is always accessible from both inside and outside the building.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

Preferred features, embodiments and variations of the invention may be discerned from the following Detailed Description which provides sufficient information for those skilled in the art to perform the invention. The Detailed Description is not to be regarded as limiting the scope of the preceding Summary of the invention in any way.

DESCRIPTION OF EMBODIMENTS

Figure 1:
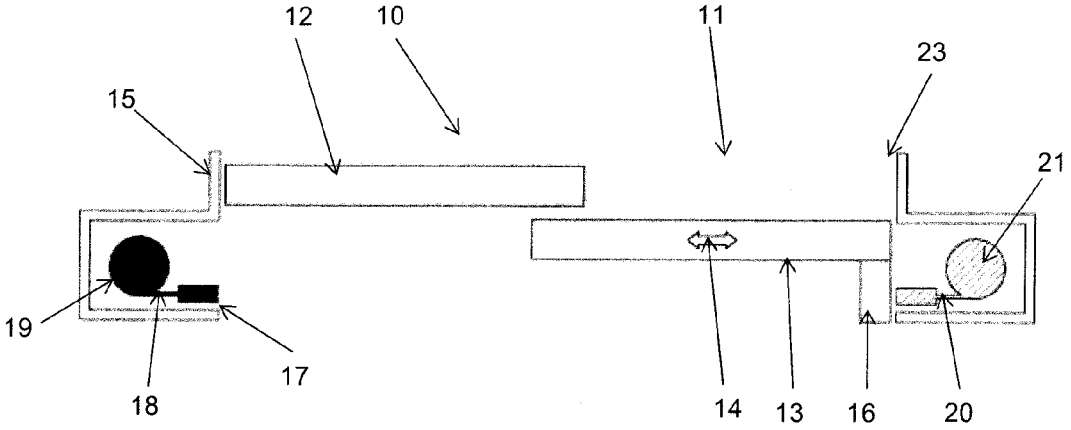
FIG. 1 illustrates a schematic view of an assembly for closing an opening according to an embodiment of the present invention.

In FIG. 1 there is shown a schematic view of an assembly for closing an opening according to an embodiment of the present invention. In this Figure, a sliding door assembly 10 is shown located in an opening 11 and comprising a fixed door panel 12 and a sliding door panel 13 that slides relative to the fixed door panel 12 in the direction indicated by arrow 14, The fixed panel 12 is fixed to the jamb 13 at the edge of the opening using any suitable technique.

The sliding door panel 13 is provided with a stop member 16 that extends from the surface of the sliding door panel 13. The stop member 16 is in the form of an elongate member that extends along at least a portion of the height of the sliding door panel 13.

At a first end 17 of the opening 11 there is provided an extendable member in the form of a blind 18. The blind 18 is in the form of an elongate flexible member that is wound around a rod 19 when in the retracted position as shown in FIG. 1.

At a second end 23 of the opening 11 there is provided an extendable member in the form of a screen 20, The screen 20 is in the form of an elongate flexible member that is wound around a rod 21 when in the retracted position as shown in FIG. 1.

Figure 2:
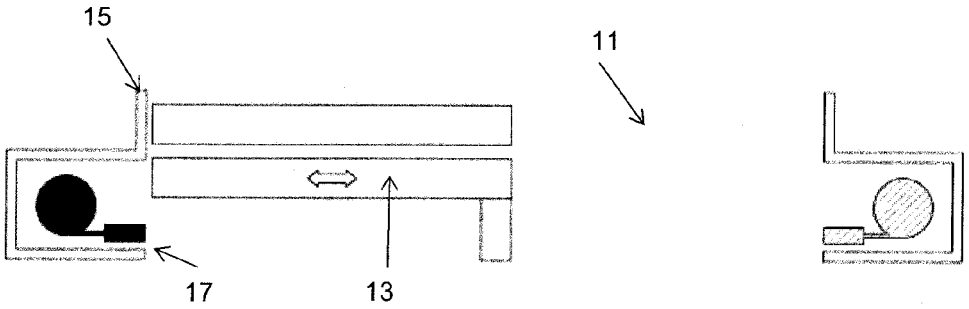
FIG. 2 illustrates a schematic view of an assembly for closing an opening according to an embodiment of the present invention.

FIG. 2 there is shown a schematic view of the sliding door assembly 10 of FIG. 1. In this Figure, the sliding door panel 13 has been opened by sliding it to the first end 17 of the opening 11 where it abuts the jamb 13.

When the sliding door panel 13 is in the position illustrated in FIG. 2, a portion of the opening 11 is open, meaning that insects, leaves and other debris can enter the structure through the opening 11.

Figure 3:
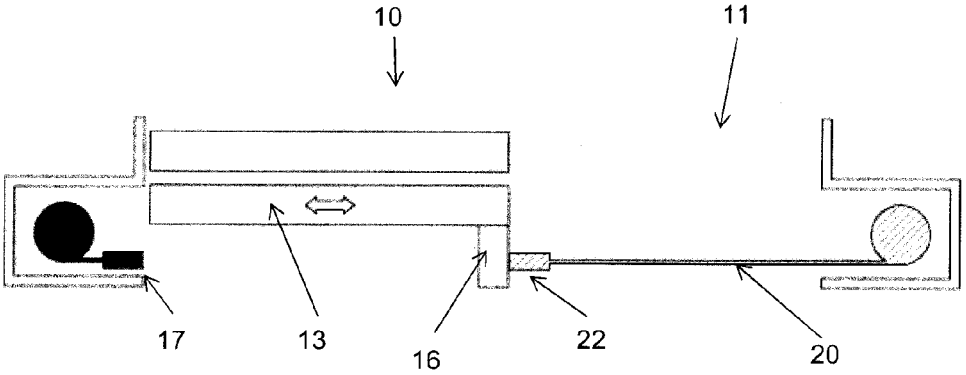
FIG. 3 illustrates a schematic view of an assembly for closing an opening according to an embodiment of the present invention.

In FIG. 3, the sliding door assembly 10 of FIG. 2 is shown in which the open portion of the opening 11 shown in FIG. 2 has been closed by extending the screen 20 towards the first end 17 of the opening 11. When the leading edge 22 of the screen 20 reaches the position of the sliding door panel 13, further movement towards the first end 17 of the opening 11 is prevented by the presence of the stop member 16. The leading edge 22 of the screen 20 abuts the stop member 16, meaning that the opening is closed, but that the screen 20 cannot extend beyond the open position of the sliding door panel 13.

Figure 4:
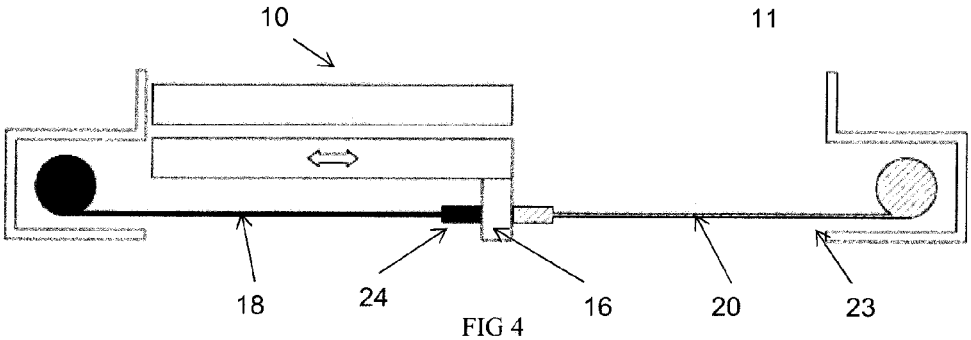
FIG. 4 illustrates a schematic view of an assembly for closing an opening according to an embodiment of the present invention.

In FIG. 4, the sliding door assembly 10 of FIG. 3 is shown, in which the blind 18 has been extended towards the second end 23 of the opening 11. In this Figure, the extension of the blind 18 towards the second end 23 of the opening 11 is limited by the location of the stop member 16 due to the fact that the leading edge 24 of the blind 18 abuts the stop member 16. Thus, the location of the stop member 16 defines the limit of the extension of both the screen 20 and the blind 18. For this reason, the blind 18 and the screen 20 are unable to overlap one another. This allows the screen 20 and the blind 18 to be provided on the same track, thereby making the assembly 10 relatively compact compared to more conventional assemblies.

Figure 5:
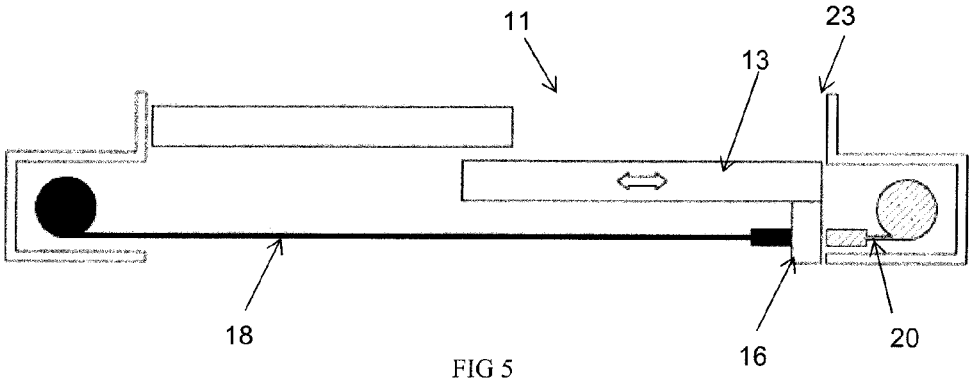
FIG. 5 illustrates a schematic view of an assembly for closing an opening according to an embodiment of the present invention.

In FIG. 5, the sliding door panel 13 has been moved to the second end 23 of the opening 11 to close the opening 11. Due to the movement of the stop member 16 with the sliding door panel 13, the screen 20 retracts around the rod 21, as the screen 20 cannot extend beyond the stop member 16.

In this Figure, it may be seen that the blind 18 has been extended to adjacent the second end 23 of the opening. In this position, the blind 18 is at the limit of its extension.

Figure 6:
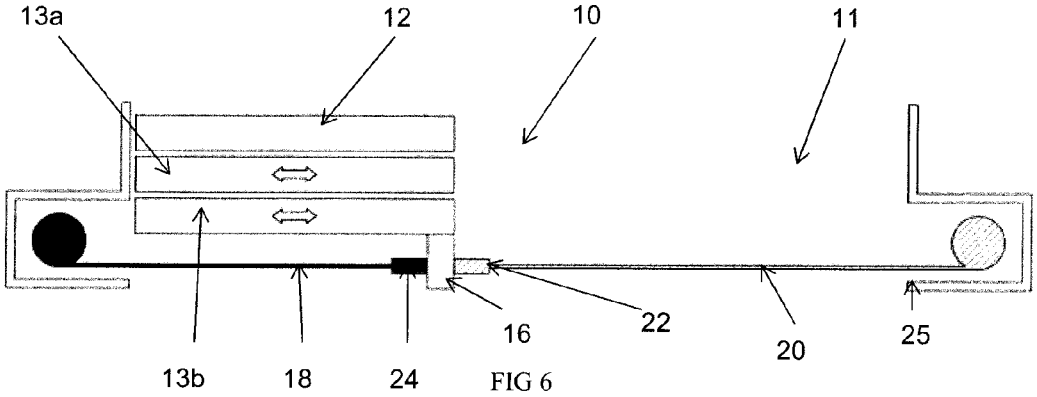
FIG. 6 illustrates a schematic view of an assembly for closing an opening according to an alternative embodiment of the present invention.

In FIG. 6, an alternative embodiment of the invention is illustrated in which the assembly comprises a fixed door panel 12 and a pair of sliding door panels 13*a*, 13*b*. When the door assembly 10 of FIG. 6 is in the closed position, sliding door panel 13*b* will abut the door jamb 25. Thus, it is sliding door panel 13*b* that is provided with the stop member 16.

In FIG. 6 the door assembly 10 is shown in the open position, and the screen 20 is in the fully extended position such that the leading edge 22 of the screen 20 abuts the stop member, thereby closing the opening 11.

In addition, the blind 18 may be extended until its leading edge 24 abuts the stop member 16.

Figure 7:
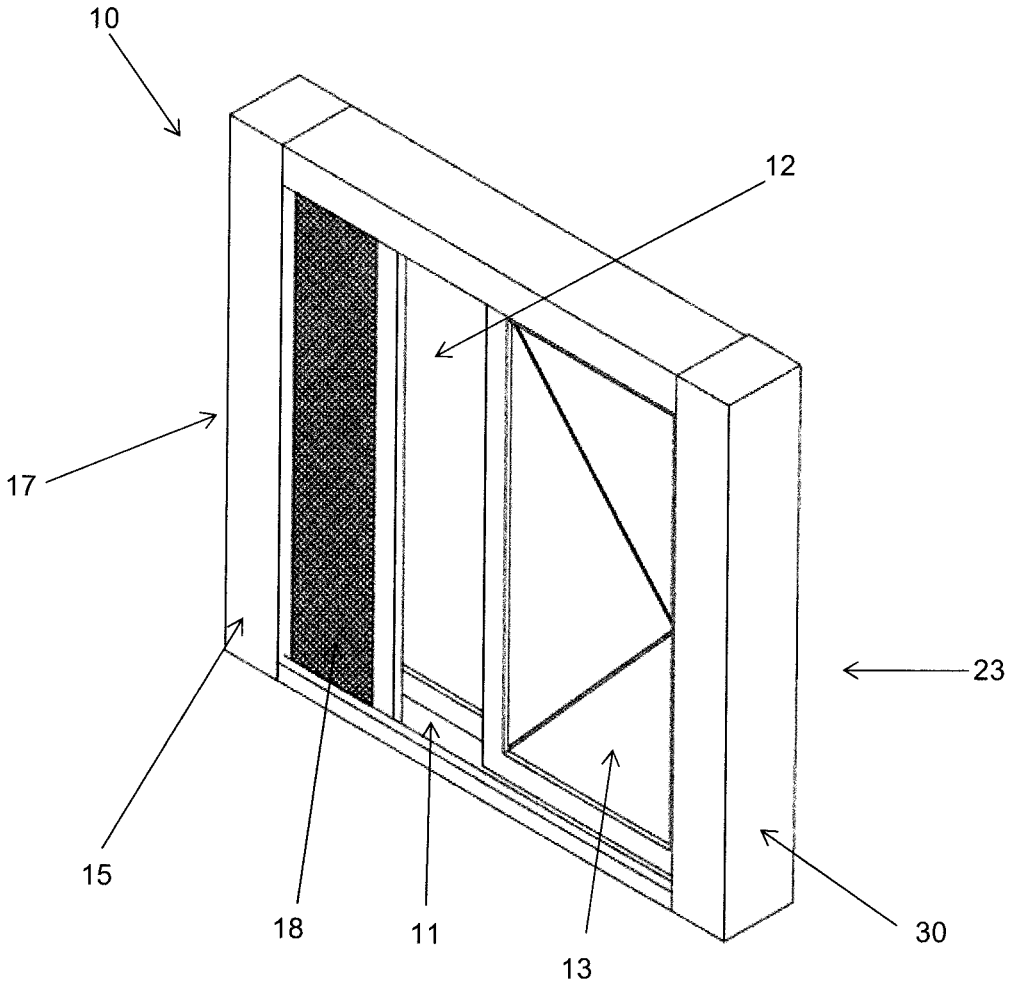
FIG. 7 illustrates an isometric view of an assembly for closing an opening according to an embodiment of the present invention.

In FIG. 7 there is illustrated an isometric view of an assembly for closing an opening according to an embodiment of the present invention. The assembly of FIG. 7 is largely identical to the sliding door assembly 10 shown in FIG. 1.

The assembly 10 comprises a fixed door panel 12 and a sliding door panel 13 that slides relative to the fixed door panel 12. The fixed panel 12 is fixed to the jamb 15 at a first end 17 of the opening 11 which also houses a flexible extendable member in the form of a blind 18 that is wound about a rod (obscured) housed within the jamb 15. The blind 18 is shown partially extended from the jamb 15.

The sliding door panel 13 includes a stop member (obscured in this Figure) that defines the limit of movement of the blind 18 towards the second end 23 of the opening 11. The jamb 30 also house an extendable member in the form of a screen (obscured) which is precluded from movement towards the first end 17 of the opening 11 by the fact that the stop member is positioned adjacent the second end 23 of the opening 11.

Figure 8:
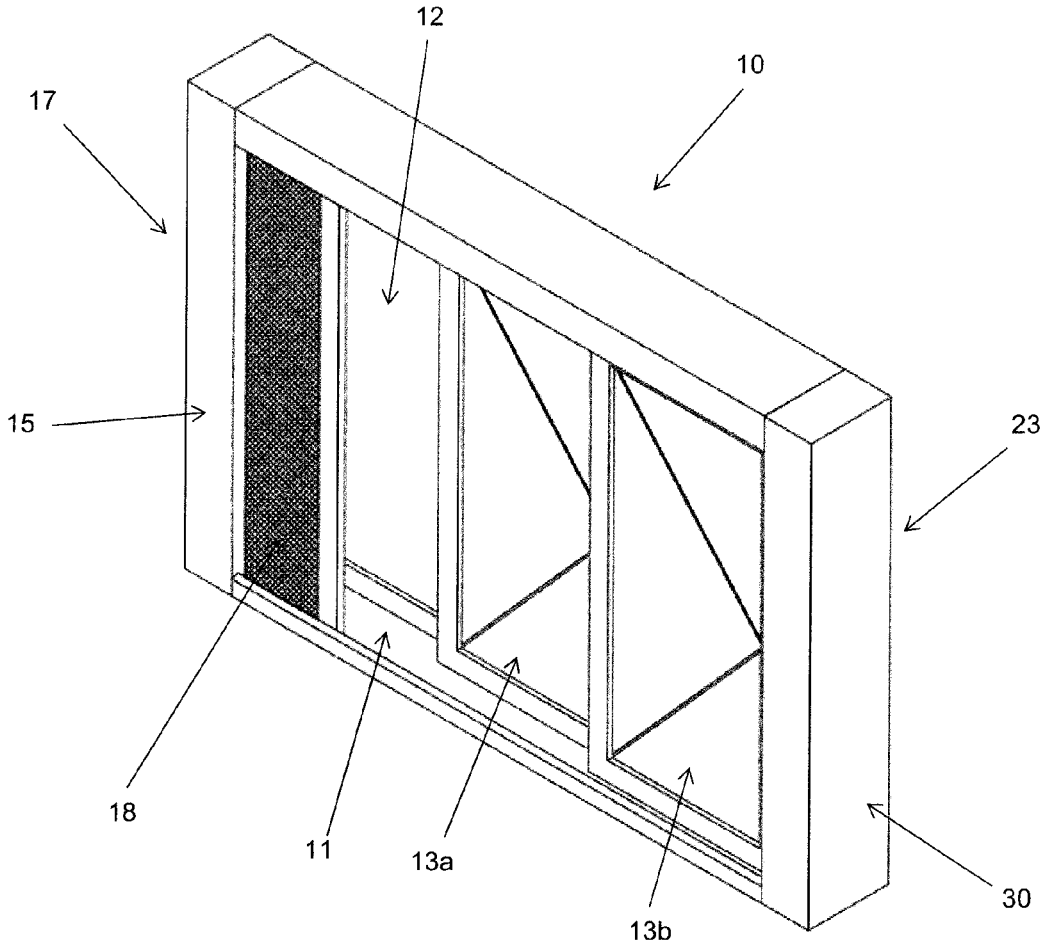
FIG. 8 illustrates an isometric view of an assembly for closing an opening according to an embodiment of the present invention.

In FIG. 8 there is illustrated an isometric view of an assembly for closing an opening according to an embodiment of the present invention. The assembly of FIG. 8 is largely identical to the sliding door assembly 10 shown in FIG. 6.

The assembly 10 comprises a fixed door panel 12 and a pair of sliding door panels 13*a*, 13*b* that slide relative to the fixed door panel 12. The fixed panel 12 is fixed to the jamb 15 at a first end 17 of the opening 11 which also houses a flexible extendable member in the form of a blind 18 that is wound about a rod (obscured) housed within the jamb 15. The blind 18 is shown partially extended from the jamb 15.

The sliding door panel 13*b* includes a stop member (obscured in this Figure) that defines the limit of movement of the blind 18 towards the second end 23 of the opening 11. The jamb 30 also house an extendable member in the form of a screen (obscured) which is precluded from movement towards the first end 17 of the opening 11 by the fact that the stop member is positioned adjacent the second end 23 of the opening 11.

Figure 9A:
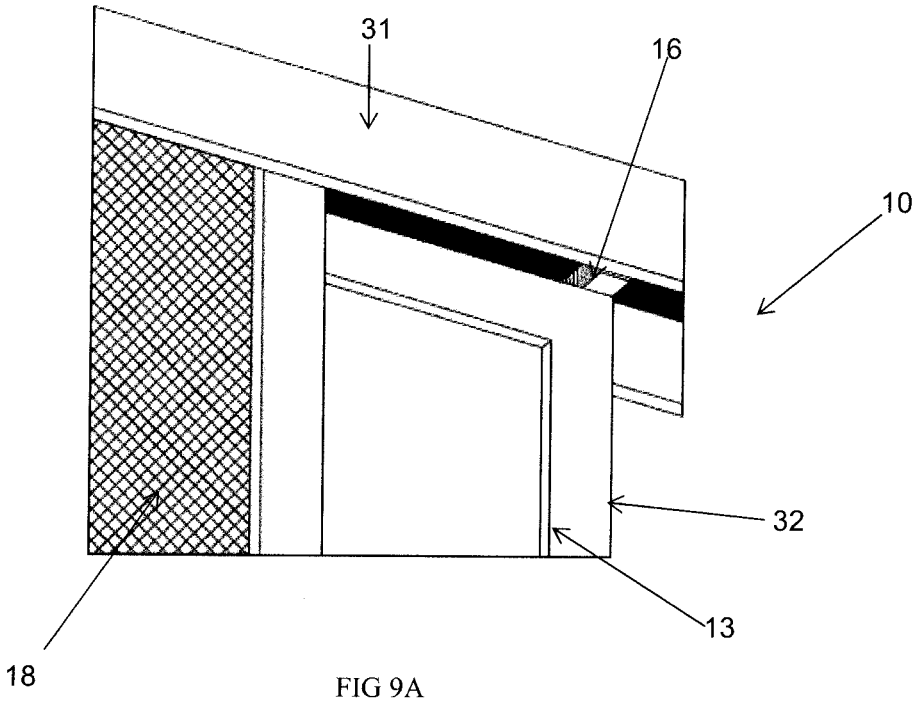
FIGS. 9A and 9B illustrate detailed views of a portion of an assembly fir closing an opening according to an embodiment of the present invention.
Figure 9B:
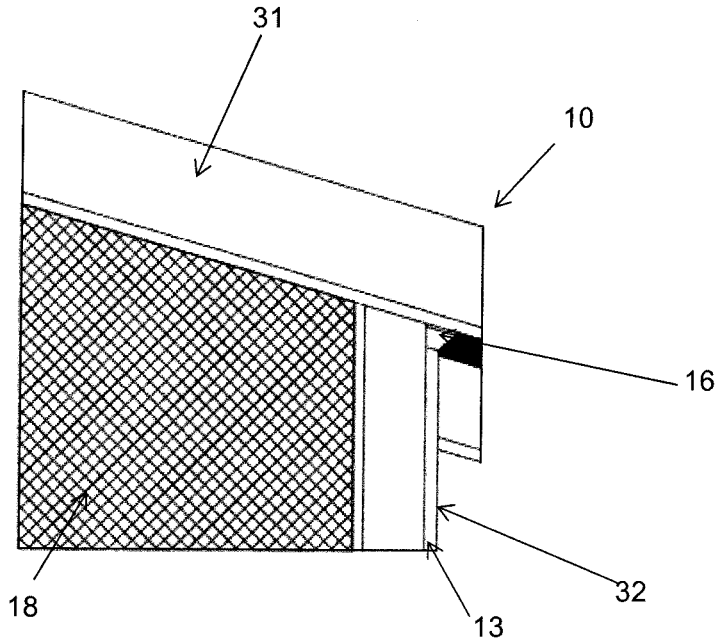

In FIGS. 9A and 9B there are illustrated detailed views of a portion of an assembly for closing an opening according to an embodiment of the present invention. In these Figures an upper portion of a sliding door panel 13 is shown, and it may be seen that a stop member 16 is positioned in the upper region of the sliding door panel 13. The stop member 16 is positioned so as to be located in use within an upper track 31 of the sliding door assembly 10. In this way, the stop member 16 is not visible to a user, and the aesthetic appeal of the sliding door assembly 10 is not disturbed. It will be noted that the stop member 16 is located at or adjacent a leading edge 32 of the sliding door panel 13.

In FIG. 9A an extendable member in the form of a blind 18 is shown in a partially extended state. In FIG. 9B, the blind 18 is extended further until it abuts the stop member 16. Thus, the stop member 16 defines the extent of movement of the blind 18 in its direction of extension. In this way, the blind 18 is prevented from extending beyond the sliding door panel 13. This ensures that the blind 18 is protected from wind, water of flying debris from outside the structure in which the assembly 10 is located.

Figure 10:
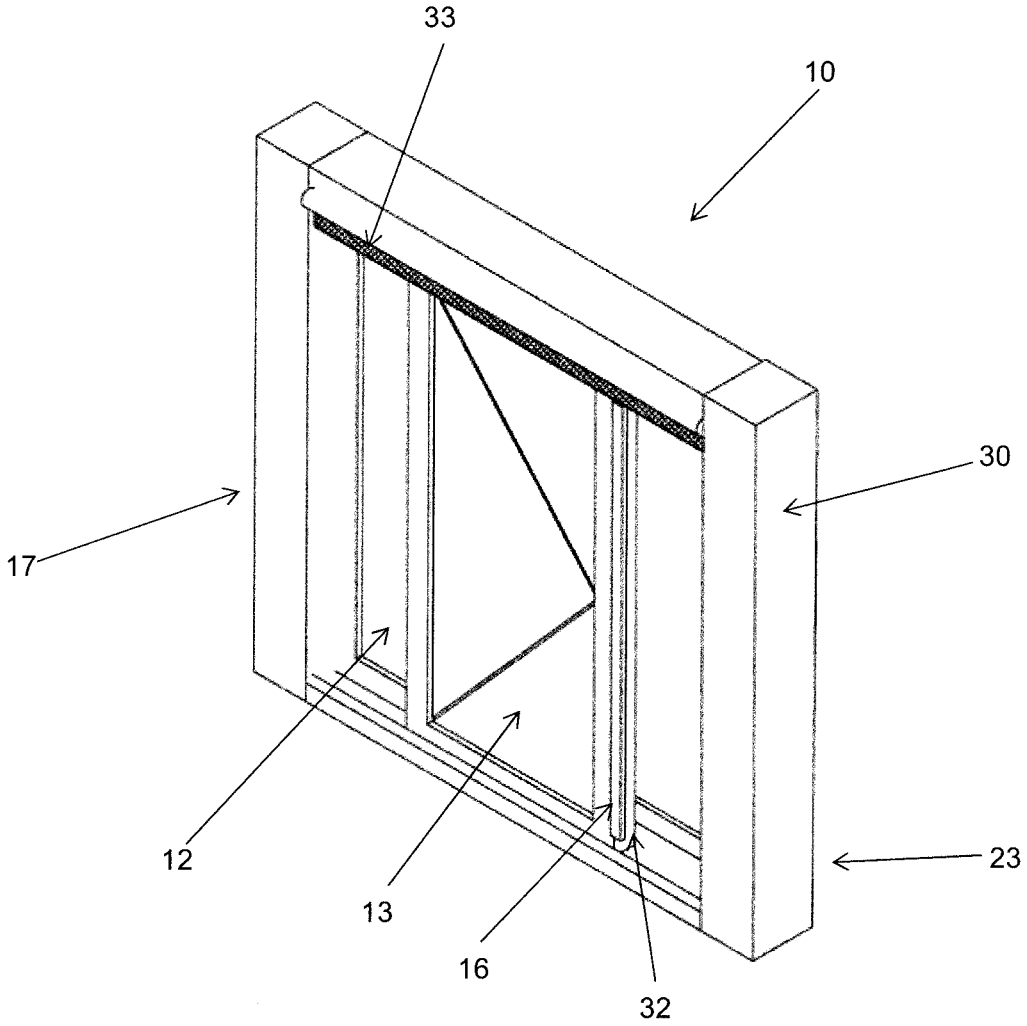
FIG. 10 illustrates an isometric view of an assembly for closing an opening according to an alternative embodiment of the present invention.

In FIG. 10 an isometric view of an assembly for closing an opening according to an alternative embodiment of the present invention is shown. The assembly is a sliding door assembly 10 comprising a fixed door panel 12 and a sliding door panel 13 that slides relative to the fixed door panel 12. The sliding door panel 13 is provided with a stop member 16 in the form of a stile that extends along a length of the leading edge 32 of the sliding door panel 13. In this embodiment of the invention, a screen (obscured) is located within the jamb 30 and is extendable towards the first end 17 of the assembly 10. The stop member 16 defines the limit of movement of the screen (obscured) in the direction in which the sliding door panel 13 slides.

In the embodiment of the invention shown in FIG. 10, a second extendable member in the form of a roller (Holland) blind 33 is shown. The roller blind 33 extends in a direction that is perpendicular to the direction of movement of the sliding door panel 13 and the screen (obscured) (i.e. the roller blind 33 extends in a substantially vertical direction). However, the roller blind 33 is prevented from extending vertically downwardly by an upper portion of the stop member 16 against which the leading edge of the roller blind 33 abuts when the sliding door panel 13 is in an open condition.

It is envisaged that, when the sliding door panel 13 is in a closed condition (i.e. when the leading edge 32 of the sliding door panel is adjacent the second end 23 of the assembly 10, the roller blind 33 will be free to extend downwardly.

In FIGS. 11A to 11D there are shown schematic views of assemblies for closing an opening according to various embodiments of the present invention.

Figure 11A:
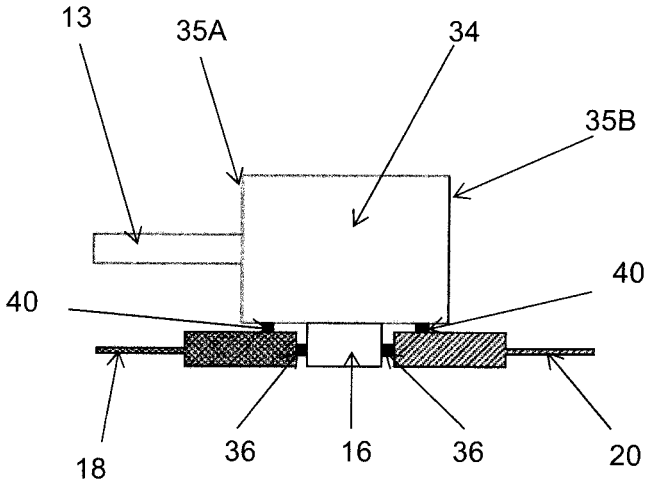
FIGS. 11A to 11C illustrate schematic views of assemblies for closing an opening according to various embodiments of the present invention.

In FIG. 11A there is shown a sliding door panel 13 including a stile 34 to which is attached a stop member 16. The stop member 16 defines the limit of movement of a blind 18 towards the right of FIG. 11A and a screen 20 towards the left of FIG. 11A. It will be noted that the stop member 16 is located substantially equidistant between opposed vertical edges 35A, 35B of the stile 34.

In this embodiment of the invention, the stile 34 and the stop member 16 are provided with magnets 36 on the surface thereof. The blind 18 and the screen 20 are also provided with magnets (obscured) that, when brought into close proximity with the magnets 36 on the stile 34 and stop member 16, retain both the blind 18 and screen 20 in magnetic engagement with the stile 34 and stop member 16. In this way, movement of the sliding door panel 13 in either direction produces an automatic movement of the screen 20 and the blind 18.

The blind 18 and the screen 20 are also provided with sealing members 40 that seal against the stile 34 when the blind 18 and the screen 20 are brought into close proximity to the stop member 16. The sealing members 40 may be of any suitable form, such as a weatherstrip or the like, and may be fabricated from any suitable material. The sealing members 40 assist in preventing the ingress of insects, leaves or other debris into the building between the stile 34 and the blind 18 or screen 20, and also assist in keeping light out of the building.

Figure 11B:
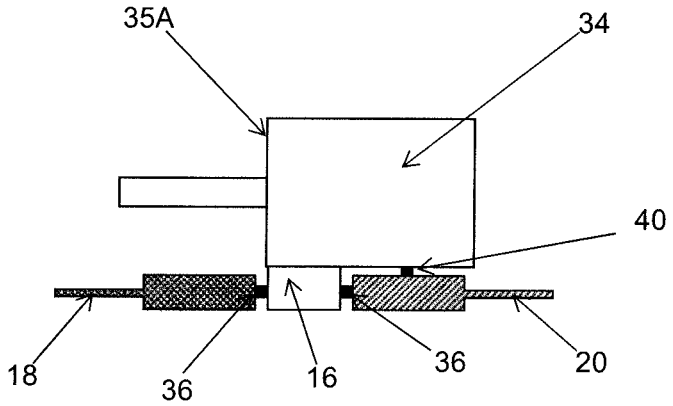

In FIG. 11B, the stop member 16 is located adjacent vertical edge 35A of the stile 34. As a result, the blind 18 is retained in magnetic engagement with the stop member 16 through a magnet 36, and no seal is formed between the blind 18 and the stile 34. However, the screen 20 is retained in magnetic engagement with the stop member 16 through magnet 36 and a seal is formed between the stile 34 and the screen 20 through sealing member 40.

Figure 11C:
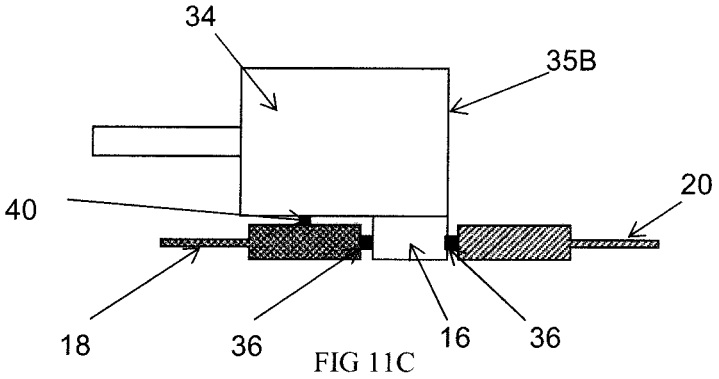

FIG. 11C is essentially a mirror image of FIG. 11B. In this Figure, the stop member 16 is located adjacent vertical edge 35B of the stile 34. As a result, the screen 20 is retained in magnetic engagement with the stop member 16 through a magnet 36, and no seal is formed between the screen 20 and the stile 34. However, the blind 18 is retained in magnetic engagement with the stop member 16 through magnet 36 and a seal is formed between the stile 34 and the blind through sealing member 40.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An assembly for closing an opening comprising:

a first extendable member located at a first edge of the opening and extendable towards an opposed second edge of the opening, a second extendable member located at the second edge of the opening and extendable towards the first edge of the opening, and a sliding door panel adapted for sliding movement between an open position and a closed position in a direction parallel to a plane defined by the direction of travel of the first extendable member or the second extendable member, wherein the sliding door panel includes two opposing ends, an obverse surface and an opposed, reverse surface, the obverse surface oriented toward the first extendable member or the second extendable member, and a stop member attached thereto and movable therewith, the stop member protruding from the obverse surface and including a first abutment surface defining the limit of movement of the first extendable member towards the second edge of the opening, and a second abutment surface defining the limit of movement of the second extendable member towards the first edge of the opening, and further wherein the first extendable member and the second extendable member are adapted for movement relative to the first edge and the second edge of the opening independently of the stop member and the sliding door panel along a common track.

2. An assembly according to claim 1 wherein the assembly comprises a plurality of door panels, one of which is said sliding panel.

3. An assembly according to claim 2 wherein the plurality of door panels includes a fixed door panel fixed at or adjacent the first edge or the second edge of the opening, and said sliding door panel is slidable relative to the fixed door panel.

4. An assembly according to claim 1 wherein the stop member comprises a projection extending from a surface of the sliding door panel.

5. An assembly according to claim 1 wherein the stop member is located on a stile.

6. An assembly according to claim 1 wherein the stop member is located within a head track or sill.

7. An assembly according to claim 1 wherein the first and second extendable members comprise elongate flexible members.

8. An assembly according to claim 1 wherein the first extendable members comprises a screen and the second extendable member comprises a blind.

9. An assembly according to claim 1 wherein at least one of the first extendable member and the second extendable member is adapted to be retained in abutment with the stop member.

10. An assembly according to claim 9 wherein said at least one of the first extendable member and the second extendable member is adapted to be retained in magnetic engagement with the stop member.

11. An assembly according to claim 9 wherein a movement of the sliding door panel produces an automatic movement of said at least one of the first extendable member and the second extendable member when said at least one of the first extendable member and the second extendable member is retained in abutment with the stop member.

12. An assembly according to claim 3 wherein the fixed door panel is fixed at or adjacent the first edge of the opening.

13. An assembly according to claim 1 wherein the first and second edges of the opening are vertical edges of the opening.

14. An assembly for closing an opening comprising:

a first extendable member located at a first edge of the opening and extendable towards an opposed second edge of the opening, a second extendable member located at a third edge of the opening and extendable towards an opposed fourth edge of the opening, and a door panel adapted for sliding movement between an open position and a closed position in a direction parallel to a plane defined by the direction of travel of the first extendable member or the second extendable member, wherein the door panel includes two opposing ends, an obverse surface and an opposed, reverse surface, the obverse surface oriented toward the first extendable member or the second extendable member, and a stop member attached thereto and movable therewith, the location of the stop member protruding from the obverse surface and including a first abutment surface defining the limit of movement of the first extendable member towards the second edge of the opening, and a second abutment surface defining the limit of movement of the second extendable member towards the fourth edge of the opening, and further wherein the first extendable member and the second extendable member are adapted for movement relative to the edges of the opening independently of the stop member and the door panel.

15. An assembly according to claim 14 wherein the first and second edges of the opening are substantially parallel to one another, and the third and fourth edges of the opening are substantially parallel to one another.

16. An assembly according to claim 14 wherein the first and second edges of the opening and the third and fourth edges of the opening are substantially perpendicular to one another.

17. An assembly according to claim 14 wherein the first extendable member comprises a screen.

18. An assembly according to claim 14 wherein the second extendable member comprises a blind.

19. An assembly according to claim 18 wherein the blind is a roller blind, Venetian blind or Roman blind.

20. An assembly according to claim 3 wherein the plurality of door panels further includes a second sliding door panel that is slidable relative to the fixed door panel.

21. An assembly according to claim 12 wherein the first extendable member is a blind.

22. An assembly according to claim 14, wherein the first extendable member and the second extendable member are adapted for movement relative to the first edge and the second edge of the opening independently of the door panel along a common track.

23. An assembly for closing an opening comprising:

a. a fixed door panel fixed at or adjacent a first edge of the opening;

b. an extendable blind member located at the first edge of the opening and extendable towards an opposed second edge of the opening; and c. an extendable screen member located at the second edge of the opening and extendable towards the first edge of the opening; and d. a door panel adapted for sliding movement between an open position and a closed position in a direction parallel to a plane defined by the direction of travel of the first extendable member or the second extendable member, the sliding door panel including two opposing ends, an obverse surface and an opposed, reverse surface, the obverse surface oriented toward the first extendable member or the second extendable member, and a stop member attached thereto and movable therewith, the stop member protruding from the obverse surface and including a first abutment surface that defines the limit of movement of the extendable blind member towards the second edge of the opening such that the extendable blind member is precluded from overlying a gap formed between the stop member and the second edge of the opening, and a second abutment surface that defines the limit of movement of the extendable screen member towards the first edge of the opening when the door panel is not in the closed position;

wherein the extendable blind member and the extendable screen member are adapted for movement relative to the first edge and the second edge of the opening independently of the stop member and the door panel along a common track.

* * * * *